United States Patent [19]

Imhof et al.

[11] Patent Number: 5,034,066

[45] Date of Patent: Jul. 23, 1991

[54] METHOD FOR WASHING AND RINSING CHEMICALLY METALLIZED SUBSTRATE SHEETS

[75] Inventors: Otwin Imhof, Nürtingen; Holger Kistrup, Esslingen, both of Fed. Rep. of Germany

[73] Assignee: Deutsche Automobilgesellschaft mbH, Fed. Rep. of Germany

[21] Appl. No.: 567,892

[22] Filed: Aug. 15, 1990

[30] Foreign Application Priority Data

Aug. 29, 1989 [DE] Fed. Rep. of Germany ..... 3928500

[51] Int. Cl.[5] ..... B08B 3/06

[52] U.S. Cl. ..... 134/33; 134/152; 134/153; 8/154; 8/155.1

[58] Field of Search ..... 8/154, 155.1; 134/33, 134/152, 153

[56] References Cited

U.S. PATENT DOCUMENTS 1,131,270 3/1915 Quick ..... 8/154
3,233,437 2/1966 Windhausen ..... 68/150
3,413,080 11/1968 Schlagenhof et al. ..... 8/154

FOREIGN PATENT DOCUMENTS 1117089 10/1984 U.S.S.R. ..... 134/33

OTHER PUBLICATIONS

In re Durden, Jr., "Invention—Definition", 226 U.S.P.Q. 359.

*Primary Examiner*—Theodore Morris
*Assistant Examiner*—Zeinab El-Arini
*Attorney, Agent, or Firm*—Evenson, Wands, Edwards, Lenahan & McKeown

[57] ABSTRACT

A process for washing and rinsing substrate sheets, in particular of nonwoven fabric or needle-punched felt sheets, is used after previously carried out activation and electroless chemical metallization. The pores or the surfaces of the substrate sheets are adequately freed from the salt residues of the metallizing solution. In this process, the textile material is wound spirally onto the rotor of a drum, and the washing or rinsing water is fed into the textile material via a hollow shaft of the rotor. The washing, rinsing, and spinning operations proceed in one apparatus, resulting in an appreciable savings in the amounts of water supplied. The entire washing and spinning operations in the drum lends itself to complete automation.

1 Claim, 1 Drawing Sheet

METHOD FOR WASHING AND RINSING CHEMICALLY METALLIZED SUBSTRATE SHEETS

BACKGROUND AND SUMMARY OF THE INVENTION

The present invention relates to a method for washing and rinsing chemically metallized substrate sheets and, more particularly, to such a method used for nonwoven fabric sheets or needle-punched felt sheets which have been chemically metallized after a preceding activation.

Nonwoven fabrics and needle-punched felts made of textile material have recently acquired ever-increasing technical significance. This is due, on one hand, to the fact that these products, which are produced from synthetic fibers, continue to suggest themselves for growing markets in the filter sector, insulator sector, and sound and acoustic insulation sector. There is also an increasing demand in the lining sector or generically related application fields owing to inexpensive production, convenient variability of thickness, porosity etc. Of the products. On the other hand, however, the increasing significance is further due to the fact that it has been possible deposit a metal layer on fiber surface of woven fabrics and needle-punched felts made of synthetic fibers and impart additional beneficial features due to the metal coating, such as electrical conductivity, screening action and magnetic properties. As a result, these textiles comprised of a conventional synthetic material became usable for all those applications in which typically metallic properties accompanied by as porous a substrate sheet structure as possible are important.

It is part of the technical procedure in metallizing the textile materials that a catalytically active substance, usually containing noble metal, is first deposited on the fiber surface. This process step is normally described by the term "activation" because the chemically inactive fiber surface of synthetic material is activated for the chemical metal deposition in this operation. Frequently Pd/Sn compounds which are deposited from ionogenic, complexly dissolved or colloidal solution on the fiber surface are used for the activation. Depending on the requirements the excess/consumed activation solution has to be removed from the pores of the nonwoven fabric or needle-punched felt after this activation step, after which the plat textile material (possibly after essential preparatory intermediate treatments) is then chemically metallized by immersing the substrate in a chemical metallizing solution. The metals deposited in the metallization are usually copper or nickel, but other metals may also in principle be deposited on a nonwoven fabric or needle-punched felt which has previously been suitably activated.

Among the characteristics of the chemical metallizing solutions are that they contain the appropriate metal in ionogenically or, alternatively, complexly dissolved form in addition to a suitable reducing agent which is also dissolved. Dissolved metal ions reducing agents can only be kept in solution along-side each other in a metastable manner, however, with the result that, on contact of such a solution with the activated fiber surface, the catalytically initiated chemical metal deposition on the fiber surface on the nonwoven fabric or needle-punched felt begins. The deposition rate and quality of the chemically deposited metal coating on the fibers can, also, be controlled by adjusting the pH and deposition temperature.

A description of the chemical principles of metallizing synthetic material is to be found in "Kunststoffgalvanisierung" (Synthetic Material Electroplating) (E. Leuze Verleg, Saulgau), and of methods for activating and metallizing nonwoven fabric sheets or needle-punched felt sheets in U.S. Pat. Nos. 3,682,671; 3,011,920; and 4,187,198, and also in German Patent Specifications 3,631,055; 3,637,130; and 3,710,895.

After chemical metallization has been carried out, it is important to remove the residue of the metallizing solution such as, for example, the oxidized reducing agent, excess complexing agent, pH regulations, metal residues etc., from the pores or from the fiber surface of the nonwoven fabric or of the needle-punched felt. This is demanded, first of all, by the toxicity of the reaction products of the chemical metallization, which would, in addition, impair the porous, metallic properties of the metallized textile material on drying. Moreover, in a subsequent electroplating reinforcement of the chemically deposited metal coating which is often required, the electroplating bath cannot be loaded in an uncontrolled manner with salt residues from the metallizing bath without also being damaged.

It has been conventional to provide for mechanically removing the consumed chemical metallizing solution from the pores of the nonwoven fabric or needle-punched felt. The same applies, of course, to rinsing operations which may also take place; the textile material is filled with washing water which is then mechanically removed from the pores of the textile material in the same way as the metallizing solution was previously removed. It is necessary to repeat the washing and rinsing operation just often enough to free the metallizing solution sufficiently for further treatment and use.

Common mechanical methods for removing the process or reaction solutions are, for example, removal by suction, beating or spinning. For this purpose, the prior art provides for winding the activated nonwoven fabric sheet or needle-punched felt sheet spirally onto a rotor, securing the rotor by placing and attaching a porous collar around the rotor, and then bringing the rotor, either in the vertical or horizontal position, into contact with the metallizing solution for the purpose of chemical metallization, spinning off the consumed metallizing solution after completion of the reaction, then flooding the rotor by immersion in an excess of washing solution, for allowing the washing solution to drain, and spinning the rotor again, etc., until only moisture residues are finally left in the pores of the nonwoven fabric sheet or needle-punched felt sheet but no salts of the metallizing solution or only insignificant amounts remain. With porosities of the textile material of between 40 and 98%, two to three washing operations associated with the respective spinning steps are, for example, usual.

Disadvantages of the known mechanical methods results from the fact that the amounts of the rinsing waters used are high, considering also the frequency of the necessary rinsing operations. As a result of the passive components of the rotor, the amounts are often even greater than corresponds to the free pore volume of the nonwoven fabric sheets or needle-punched felt sheets, which therefore necessitates elaborate and expensive waste water disposal and also involves at least, indirectly, pollution of the environment.

To make matters worse, if flow from individual fibers or even from entire sections of nonwoven fabric or needle-punched felt is uneven, the draining washing water may entrain the metal coating of the fibrils. It must furthermore be mentioned that the washing/rinsing, on one hand, and spinning, on the other hand, usually take place in different containers, and this implies a cumbersome additional handling which has to be repeated several times. It is also necessary, especially in the case of a horizontally disposed rotor during the spinning, to rinse into a washing trough with an appropriate arrangement of the nonwoven fabrics or the needle-punched felts for the purpose of effectively washing the rotor so that the purification from salt residues of the metallizing solution takes place uniformly enough over the entire area of the textile material. This approach rules out a cost-beneficial, automatically operating integrated washing and spinning plant.

An object of the present invention is, therefore, to provide a method for washing and rinsing chemically metallized substrate sheets, in particular nonwoven fabrics or needle-punched felts, in which the residues of the chemical metallizing solution are removed as extensively as possible from the pores or from the surface of the metallized nonwoven fabric sheets or needle-punched felt sheets. Another object is to provide a method which uses lesser amounts of washing water, after chemical metallization of the substrate and which is simpler in terms of handling and monitoring.

The foregoing objects have been achieved, in accordance with the present invention by providing a method in which a nonwoven fabric sheet or needle-punched felt sheet having a porosity of 40 to 98%, a fiber thickness of 1.6 to 3.5 dtex and a weight per unit area of 70 to 500 g/cm$^2$ is wound onto the hollow shaft of the washing drum. The wound-on sheet loaded with consumed and/or unconsumed metallizing solution is rinsed with washing water in the centrifugal field of the drum radially from the inside outwards, initially with a hollow shaft rotary speed of 500 to 1200 min$^{-1}$. The metallizing solution is spun out of the sheet and therefore supplying as much washing water terms of volume is supplied to the sheet via the hollow shaft in every washing operation as is present in the free pore volume of the sheet. The hollow shaft is rotated with a rotary speed of 20 to 300 min$^{-1}$ during the inflow of the washing water and the hollow shaft then again is rotated with speed of 500 to 1200 min$^{-1}$, the washing water in question being spun off in the centrifugal field. The result is that the residual moisture content of trapped water, adhering water or capillary water in the pores of the sheet is ultimately not more that 5%.

In this process, in a washing drum the spirally wound-on nonwoven fabric sheet or needle-punched felt sheet remains disposed in practice on the rotor, which is provided with a collar, during the entire washing and spinning operations. The residue of the consumed metallizing solution is first expelled from the substrate by spinning the rotor at a suitable rotary speed (for example, 600–800 min$^{-1}$), then the necessary amount of washing water is introduced into the nonwoven fabric sheet or needle-punched felt sheet through suitable openings on the rotor surface at low rotary speed (less than 500 min$^{-1}$) centrally from the hollow shaft of the rotor. The amount of washing water is such that at a maximum, it is able to fill the free pore volume of the nonwoven fabric sheet or needle-punched felt sheet. After the substrate has been filled with washing water while rotating the rotor at low rotary speed (less than 500 min$^{-1}$), the rotary speed is again increased to the necessary spinning rotary speed (for example 800 min$^{-1}$). Depending on the required degree of purity in relation to the salt residues of the consumed metallizing solution, the rinsing and spinning operation can be repeated as often as desired in the manner described above without the sheet of textile material having to be rewound or unwound. Also, it is without the contemplation of the present invention to program or automate the spinning and washing operation in the case of constant metallization of sheets on the same application.

The advantages of the method according to the invention are, in particular, that the residues of the chemical metallization solution are extensively removed from the pores and from the surface of the metallized substrate. Furthermore, a lesser amount of washing water, with regard to the individual washing operations, is required. The method simplifies the handling of the entire washing process of the substrate sheets and opens up the possibility of an automatic control, which can be carried out conveniently, of the entire washing and spinning operation for metallized substrate sheets.

BRIEF DESCRIPTION OF THE DRAWINGS

These and other features, objects and advantages of the method in accordance with the present invention will become apparent from the following detailed description of a presently preferred mode of carrying out that method when taken in conjunction with the accompanying drawing wherein.

DETAILED DESCRIPTION OF THE DRAWINGS

Figure 1:
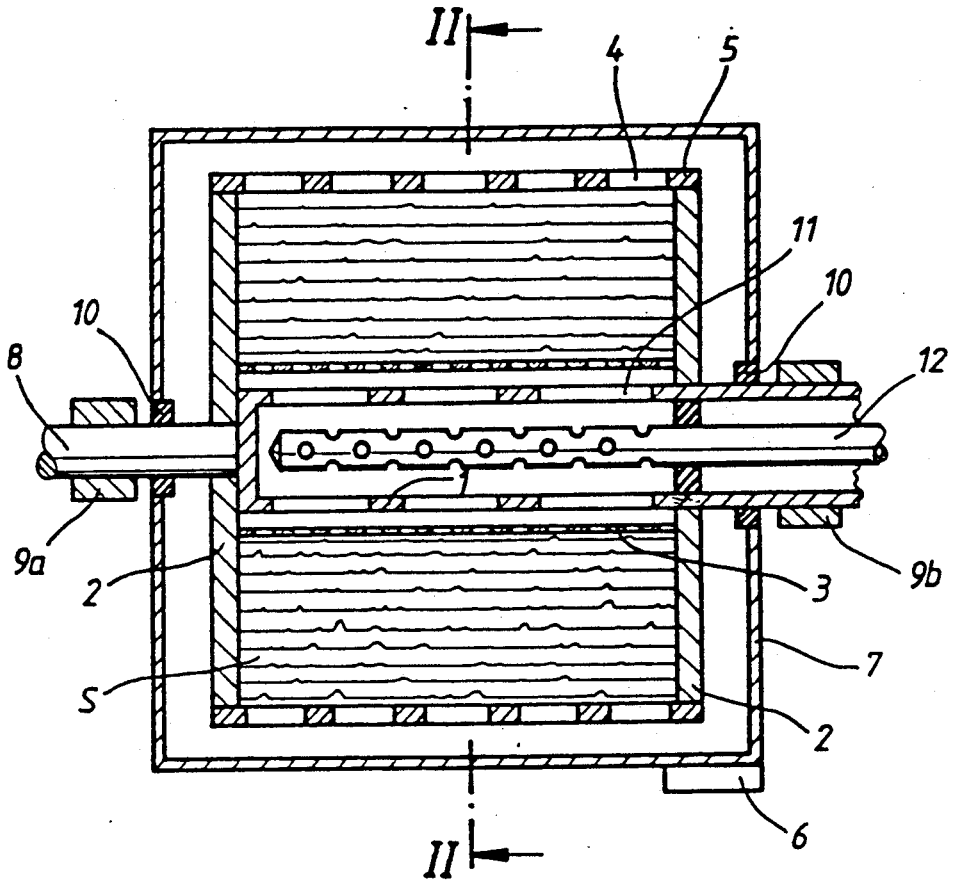
FIG. 1 is a section through an elevational view of drum with the wound-on substrate.
Figure 2:
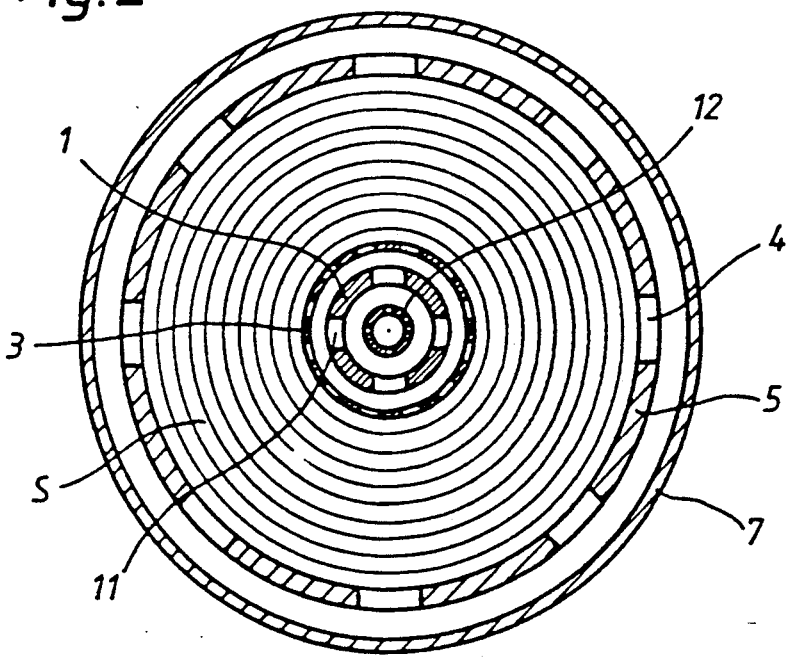
FIG. 2 is a sectional view along line II—II in FIG. 1.

In a drum having the two end faces 2, a chemically nickel-plated polypropylene substrate such as needle-punched felt sheet S having a porosity of 92%, a fiber thickness of the textile material of 1.6 to 3.5 dtex, a weight per unit area of 70 to 500 g/cm$^2$ and a calculated free pore volume of 25 1 is wound spirally onto an outer drum core 3 which is provided with small holes and which is coaxial with a hollow shaft 1. The substrate S is flush with the two inside end faces 2 of the drum. Outwardly the substrate S is held by a collar 5 which is provided with holes 4 so that mechanically separated water can escape from the pores of the needle-punched felt sheet through the holes 4 in the collar 5 during the spinning operation and can be drained via a washing water discharge opening 6 in a washing water collection housing 7. The drum is centrally mounted, on one hand, by the hollow shaft 1, which has elongated hole slots in the region of the wound-on substrate S. A solid shaft 8 and the hollow shaft, each mounted in the bearings 9*a* and 9*b* outside the washing water collection housing 7. Radial sealing rings 10 prevent rinsing water from penetrating outwards. An annular space exists between the hollow shaft 1 which is provided with elongated hole slots 11 and the perforated supporting surface 3 of the wound-on substrate for uniformly distributing the washing water over the entire supporting surface of the substrate S.

A uniform distribution of the washing water over the entire circumference is ensured by matching the flow resistance of t holes of the outer core 3 of the hollow shaft 1 to the wettability and porosity of the textile material and by achieving a greater flow resistance in the case of the outer core 3 of the drum than in the case of the elongated hole slot geometry of the hollow shaft 1. The rinsing and washing water is supplied via a fixed inlet pipe 12 which projects into the shaft 1 and is provided with holes over its circumference in the region of the substrate and over the drum length, and is sealed with respect to the hollow shaft 1 with a radial sealing ring. The disposition of the openings in the washing water inlet pipe 12 is such so as the ensure, even at the lowest washing water delivery amount to be adjusted, that the washing water emerges from all the openings, even from the one situated furthest in the interior of the drum. As a result, no sections of the substrate are preferentially exposed to washing water. The drum can be conventionally driven during the diverse process steps, e.g. by a belt pulley. During the inflow of washing water, rotation is carried out at a rotary speed of less that 500 $min^{-1}$, preferably at 50 to 100 rev/min, while the rotary speed is increased to 800 to 900 rev/min during the spinning operation.

The advantages of the method according to the invention are, in particular, that the residues of the chemical metallization solution are extensively removed from the pores and from the surface of the metallized substrate. A lesser amount of washing water, with regard to the individual washing operations is required. The method of the present invention thus simplifies the handling of the entire washing process of the substrate sheets and opens up the possibility of a conveniently implemented automatic control of the entire washing and spinning operation for metallized substrate sheets.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A method for rinsing and washing nonwoven activated and chemically metallized fabric sheets and needle-punched felt sheets which have, of a porosity of 40 to 98% a fiber thickness of 1.6 to 3.5 dtex and a weight per unit area of 70 to 500 $g/cm^2$, comprising the steps of winding the sheets onto a horizontally disposed hollow shaft of a washing drum, rotating the washing drum initially with a hollow shaft rotary speed of 500 to 1200 $min^{-1}$, rinsing the wound-on sheet loaded with consumed and/or unconsumed metallizing solution with washing water in a centrifugal field of the rotating washing drum radially from the inside outwards, so that the metallizing solution is spun out of the sheet, and thereafter supplying as much volume of washing water to the sheets, via the hollow shaft, in each washing operation as is present in the free pore volume of the sheet with the hollow shaft being rotated with a rotary speed of 20 to 300 $min^{-1}$ during inflow of the washing water and then with the hollow shaft again being rotated at a speed of 500 to 1200 $min^{-1}$, and spinning off the washing water in the centrifugal field, with the result that the residual moisture content of trapped water, adhering water or capillary water in the pores of the sheet is ultimately not more than 5%.

* * * * *